United States Patent [19]

Bulka et al.

[11] Patent Number: 4,525,118

[45] Date of Patent: Jun. 25, 1985

[54] BOOK STACKER

[75] Inventors: Raymond I. Bulka, Oak Lawn; Russell S. Ketcham, Tinley Park; Kelvin K. Mak, Lyons, all of Ill.

[73] Assignee: McCain Manufacturing Corporation, Chicago, Ill.

[21] Appl. No.: 473,135

[22] Filed: Mar. 7, 1983

[51] Int. Cl.[3] ..... B65H 31/30

[52] U.S. Cl. ..... 414/43; 198/627; 198/860; 271/219; 271/224; 414/49; 414/52; 414/91; 414/900

[58] Field of Search ..... 414/31, 43, 46, 48, 414/49, 52, 86, 82, 91, 900; 198/627, 860, 862; 271/213, 219, 224; 209/521

[56] References Cited

U.S. PATENT DOCUMENTS

| | | | |
|---|---|---|---|
| 2,901,952 | 9/1959 | Taylor | 414/91 X |
| 2,974,777 | 3/1961 | Marsh | 198/860 |
| 3,022,999 | 2/1962 | Mead | 271/224 |
| 3,390,619 | 7/1968 | Williams | 414/49 |
| 3,532,230 | 10/1970 | Gutberlet et al. | 414/31 |
| 3,704,882 | 12/1972 | Brookhyser | 414/86 X |
| 3,822,793 | 7/1974 | Stobb | 414/43 |
| 4,030,621 | 6/1977 | Swanson et al. | 414/91 X |
| 4,403,899 | 9/1983 | Lampe et al. | 414/35 |

FOREIGN PATENT DOCUMENTS

| | | | |
|---|---|---|---|
| 1236412 | 3/1967 | Fed. Rep. of Germany | 414/49 |
| 2431329 | 2/1975 | Fed. Rep. of Germany | 198/627 |

*Primary Examiner*—Leslie J. Paperner

*Attorney, Agent, or Firm*—Kinzer, Plyer, Dorn & McEachran

[57] ABSTRACT

A book stacker for thick or thin books in which an input conveyor for feeding the books in a stream to a transfer conveyor is adjustable for the thick-thin situation, and the transfer conveyor likewise; in which a partial stack of books is dropped to a collecting conveyor which gathers a full stack, the collecting conveyor being suspended resiliently; and in which the stack being gathered is stabilized.

13 Claims, 11 Drawing Figures

11
11
2
2
30T
30
62
65
64
82
86
80
68
76
84
66
79
72
87
122
127
108
136
134
132
88
96
95
101
102
98
34
105
124
107
116
130
112
114
52
248
110
56
70
249
54
92
90
118
243
237
128
120
150
148
146B
144
106
42
161
239
246
330
240
366
45
262
5K
270
278
276
283
152
146A
142
40
236
395
200
220
214
290-1
280
156
157
158
46
170
390
286
288
289
290
366
190
159
160
50

BOOK STACKER

This invention relates to a machine for assembling a stream of books into a partial stack and then into a larger stack before delivering the completed stack to a station where the stack is prepared for mailing or further handling.

The present machine in particular is adapted to handle heavy, large size books such as mail order catalogs, varying in size from the thick spring and winter issues to the intermediate summer and fall sales catalogs.

One object of the invention is to so construct the machine that variable speed motors may be employed so that in the instance of a large, heavy stack the machine may be run at a slower, safer speed compared to handling thinner intermediate sales catalogs. In this same connection another object of the invention is to be able to adjust the machine to handle catalogs of different thickness, particularly when delivering the catalogs one by one along an upwardly inclined path into the bight of a conveyor at a transfer station which continues the ongoing stream in the direction of a collecting shelf where a preliminary or partial stack of books is built up. The aforementioned shelf represents an intermediate or halfway station juxtaposed to a collecting station therebeneath. Intermittently, on command, the shelf is displaced or removed to drop the partial stack onto a like partial stack on a collecting conveyor therebeneath. The collecting conveyor is responsible for delivering the full stack to the mailing or pickup station. The weight of the books being dropped from the halfway station to the collecting station may be considerable and another object of the invention is to provide a resilient suspension for the collecting conveyor to absorb the weight of the books. A related object of the invention is to stabilize the books at the collecting station by engaging the opposed sides of the books while at the same time using the related stabilizing devices to help push the books from the collecting station to the mailing or handling station. A related object of the invention is to drive the conveyors at the collecting station by means including a transmission so that the collecting conveyors are gradually brought up to speed, assuring that the books will not topple as a result of being jolted by instant acceleration.

IN THE DRAWING

GENERAL DESCRIPTION

The machine of the present invention is constructed specifically for handling thick books in the nature of catalogs, thick paperbacks and the like. The main purpose of the machine is to collect thick books of this character in a stack and deliver the stack to a receiving station where the collection of books is handled as a stack, usually for the purpose of mailing.

The thickness and weight of the books will vary considerably, especially in the instance of catalog mailing, depending on whether the catalog is the main seasonal catalog or a considerably less thick sales catalog. The present machine is so constructed as to take these variables into account, allowing for speed variations, rate variations, thickness variations, and so on.

Figure 1:
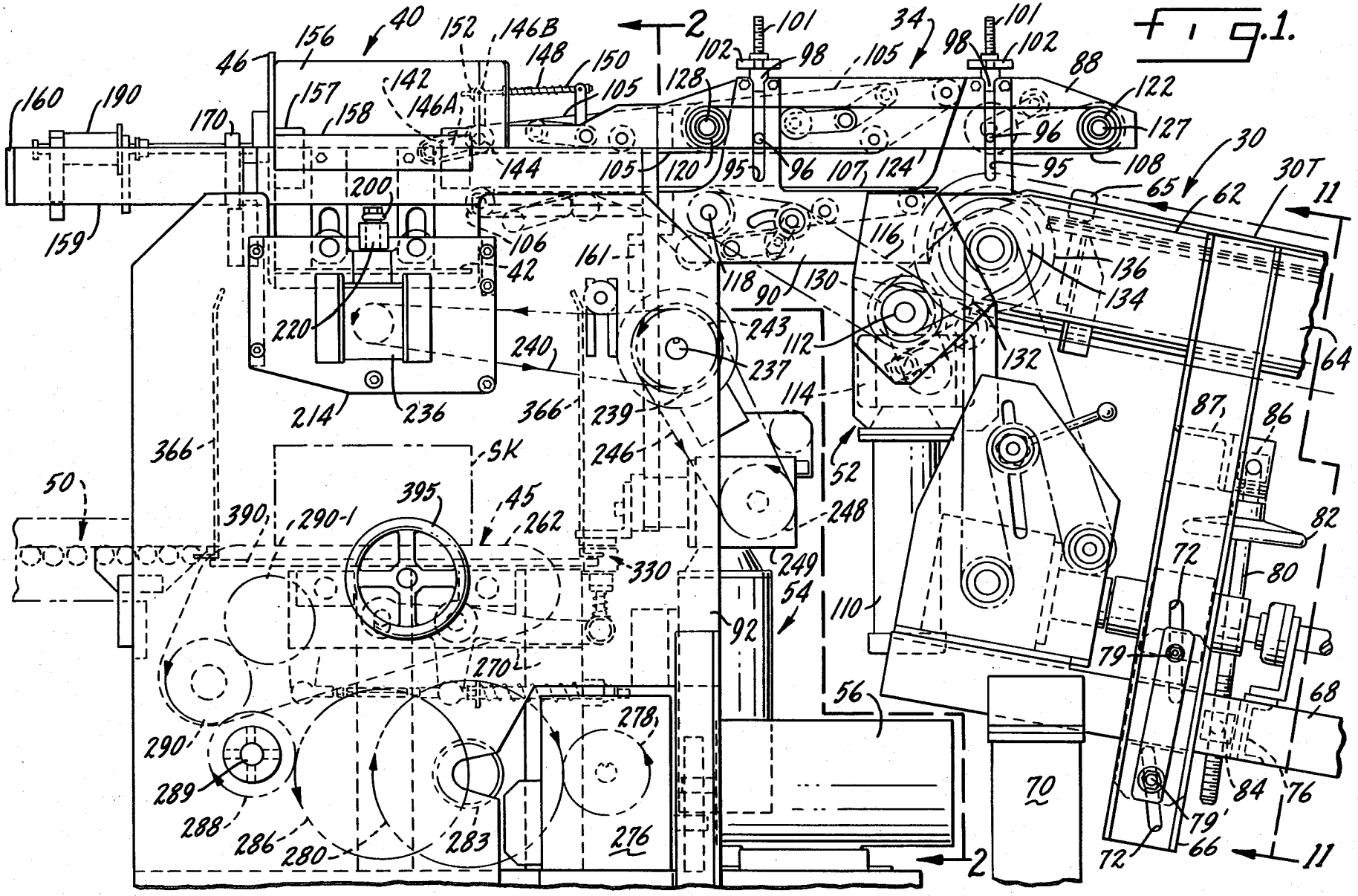
FIG. 1 is an elevation of a machine constructed in accordance with the present invention.

Referring to FIG. 1, the individual books arriving from a previous station (usually a wrapping station, not shown) are elevated by a carrier or conveyor mechanism 30, one after the other, from a lower level upwards along an inclined path to a transfer feeder 34. At the transfer feeder 34 the books continue forward, along a horizontal path, one behind the other. Eventually the leading end of the book strikes a bumper 46, FIG. 3, located at a halfway or transfer station 40, FIG. 1.

Figure 4:
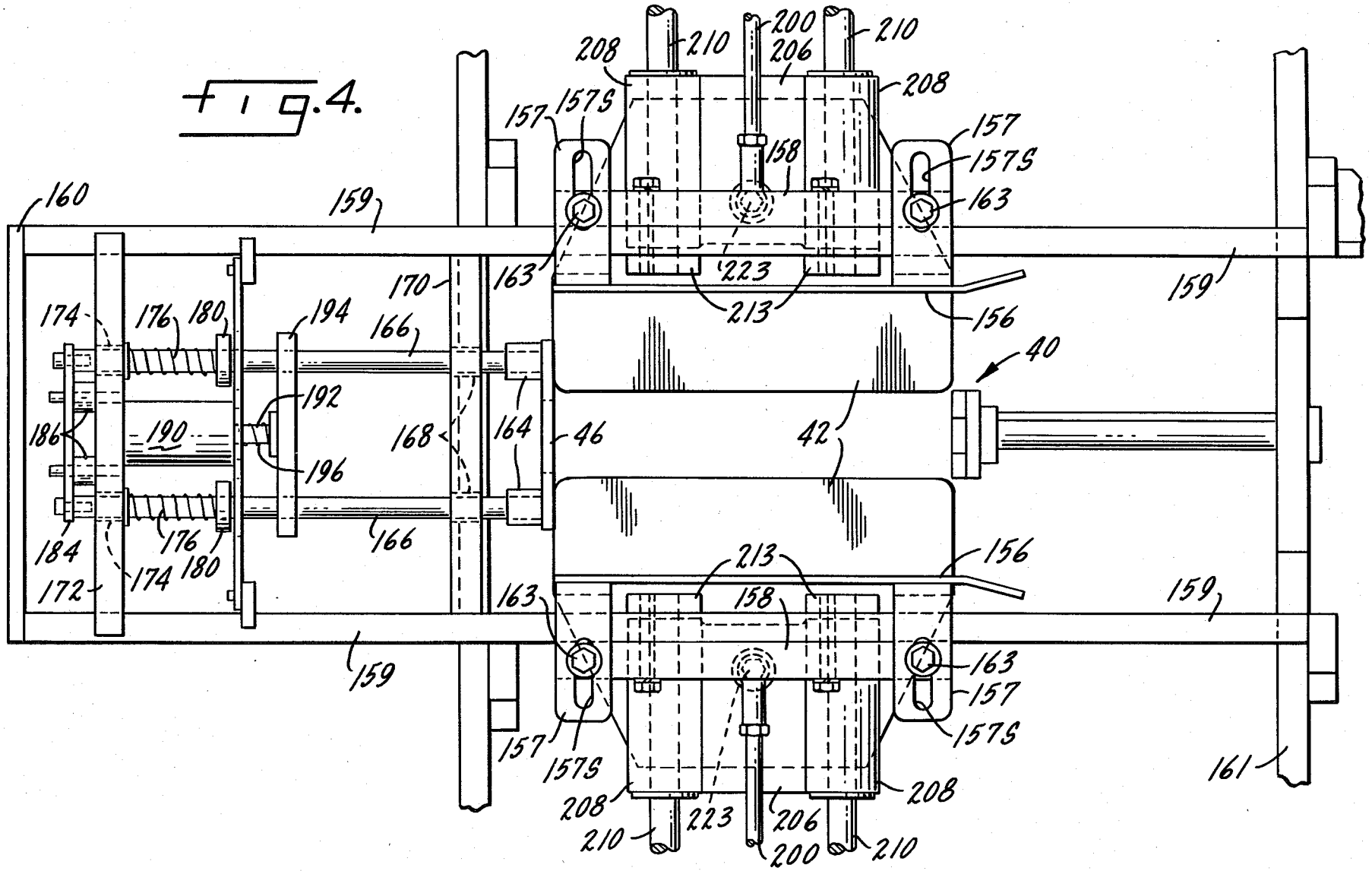
FIG. 4 is a plan view of the mechanism shown in FIG. 3.

Also as shown in FIG. 4, the transfer station 40 includes a trap door in the form of a pair of laterally spaced doors or panels 42 which, when spread or sprung open, drops the heavy book onto a collecting conveyor 45, FIG. 1. When a predetermined height or number of dropped books has been achieved the collecting conveyor 45 is actuated to deliver the stack forwardly or to the left as viewed in FIG. 1 to a receiving station 50 which is manually supervised. As will be described in more detail below, the collector conveyor 45 is resiliently suspended to absorb the shock of the falling book.

Because the thickness of books may vary considerably, the input conveyor 30 is arranged for vertical adjustment and so is the in-feeder 34, allowing an efficient delivery of the books to the halfway station. A bumper 46 at the halfway station prevents rebound of the arriving book which comes to rest on the trap door.

There are three D.C. drive motors. One motor and related gear box assembly 52, FIG. 1, is utilized to drive the input conveyor and the in-feed or transfer conveyor; a second motor and gear assembly 54 is employed to operate the trap door device 42 previously described; a third motor and gear assembly 56 is responsible for driving the collector or delivery conveyor 45 which moves the stack of books SK to the receiving station 50.

By using variable speed D.C. motors the speed of the machine is easily varied so that in the instance of high stacks (more likely to topple if moved too fast) the program by which the machine is governed may be adjusted to a slower speed for the motors.

THE INPUT FEEDER AND THE TRANSFER FEEDER

The input feeder includes a driven conveyor chain 62, FIG. 1. The conveyor chain 62 is provided with lugs or fingers 65 engageable with the back of the book. The lugs extend through slots in a support table 30T.

The sprockets for the chain 62 are supported by an inclined frame 64. The frame 64 in turn is supported for vertical adjustment by angle bars 66, adjustably mounted to a lower support frame 68, see FIG. 11. The lower frame 68 is supported above floor level by a pair of posts or legs 70, FIG. 1.

Figure 11:
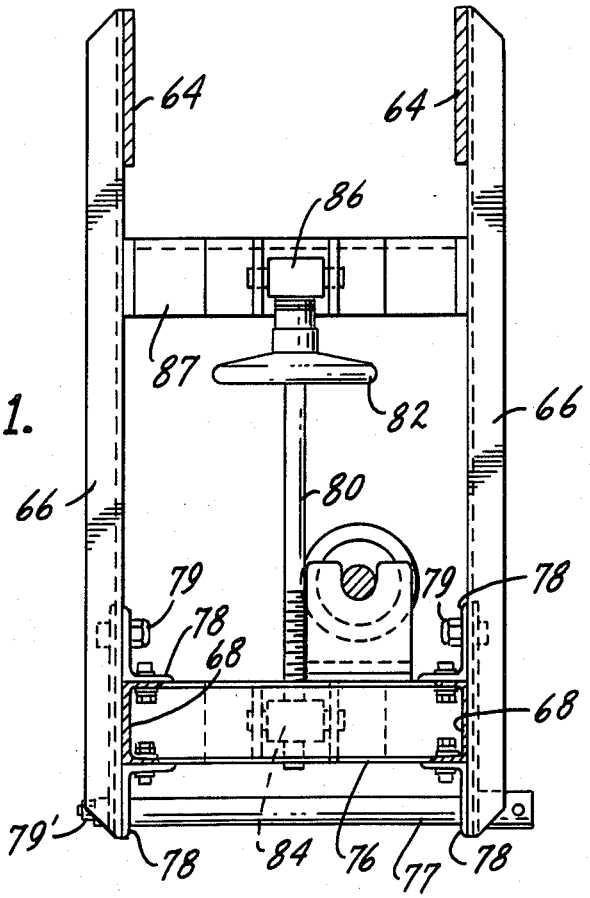
FIG. 11 is a view on the line 11—11 of FIG. 1 of an adjuster mechanism.

Vertical adjustment of the frame 64 which supports the input conveyor 62 is achieved by providing spaced, appropriately angled slots 72, FIG. 1, in each supporting angle bar 66. As shown in FIG. 11, the fixed, lower support members 68 are joined by spacers 76 and 77. Upper and lower angles 78 are bolted to the spacers 76, and to the uprights 66 by lock nuts 79. Spacer 77 is secured by a nut 79', so that by loosening these nuts 79 and 79' each upright channel member 66 can be slid up or down as the case may be, appropriately to position the input conveyor 62 with respect to the entrance throat at the back of the in-feeder 34, according to the thickness of the book being handled.

Accurate positioning of the channels 66 in the adjusting mode is made possible by a screw 80 having a hand wheel 82. The screw 80 has a long shank, with a thread of considerable length, threadedly mounted in a nut 84. The upper end of the screw shank is pivotally mounted to a swivel block 86 in turn supported by a spacer 87 connected at its opposite ends to the channel member 66 which carry and support the frame 64 for the input conveyor chain 62.

The frame for the transfer feeder 34 is also supported for vertical adjustment, accordingly to fit the book thickness. This frame is denoted by reference character 88, FIG. 1, as supported for adjustment in a second frame structure 90 rigidly supported by the main frames 62 of the conveyor 30.

The fixed, supporting frame 90, as best shown in FIG. 1, is provided with adjustment slots 95. The movable frame is provided with horizontal stub shafts 96 neatly fitting the guide slots. The fixed frame 90 at the upper end is provided with fixed blocks 98 presenting nuts receiving adjustment screws 101. These screws are provided with knobs 102 so that by turning the screws frame 88 may be raised or lowered as the case may be, manifest in the ends of the stub shafts moving up or down in the guide slots 95 of the fixed frame 90.

It can be seen, FIG. 1, that by raising (or lowering) the frame 64 the bight between the in-feed tape 108 and the delivery lugs 65 of input conveyor 62 can be adjusted properly to accept a thinner or thicker book as the case may be.

As mentioned above, the main purpose and function of the transfer feeder is to advance each thick book one after the other in a stream to the transfer station 40. This step is accomplished by an endless tape 105 (upper tape) opposed to a lower tape 106, the lower tape set 106 having its upper run in a slot in a support plate 107. The book is delivered to these two tapes by an accelerating tape or belt 108 at the right hand end of the frame 88 adjacent the input station 30. Belt 108 is driven at a higher speed than the input conveyor 62 to avoid interference with an oncoming book at the entry throat or bight where the book on conveyor 62 is grabbed by belt 108.

The various feed belts and conveyors thus far described are driven from a variable speed DC motor 110 which drives a jack shaft 112 through a worm gear box 114. A main drive chain 116 is coupled to the output of the jack shaft 112. This chain drives a sprocket 118 which in turn drives a chain (not shown) which rotates a driving sprocket 120. The sprocket 120 is coupled to a paired sprocket 122 at the right hand end of the frame 88 by a timing belt 124. Shaft 127 associated with the sprocket 122 drives an associated pulley which in turn rotates the accelerator in-feed belt or tape 108 responsible for advancing the approaching book delivered by the conveyor 62 into the throat between the in-feeding belts 105 and 106.

By the same token, the shaft 128 which carries sprocket 120 carries a pulley (not shown) which drives the upper infeed tape 105. By a similar arrangement, shaft 118 supports a pulley for the lower feed tapes 106 and from this it can be seen that shaft 118, driven by chain 116, is responsible for moving all three sets of tapes or belts 105, 106 and 108 at the same linear speed. Various tensioners and idlers are shown in FIG. 1 but are not necessary to an understanding of the present invention.

The jack shaft 112 rotates a pair of sprockets 130 driving chains 132 trained at their opposite ends about driven sprockets 134 which in turn support resilient wheels 136. The wheels 136 in cooperation with the belt 108 engage and accelerate the book away from conveyor lugs 65 which feed the book to the throat represented by belt 108 and wheels 136.

A means is provided at the delivery end of the transfer feeder to apply a downward thrust to the book as it leaves the transfer feeder belts 105–106. To this end, FIG. 1, a downwardly inclined guide belt 142 is trained about a pulley set including a drive pulley 144 deriving its rotation from a pulley shaft for the upper feed belt 105 as will be readily seen in FIG. 1. The pulley set for the guide belt 142 is carried on one arm 146A of a bell crank and the opposite arm 146B is spring-biased in the manner of the rear brake of a motorcycle, as will be apparent in FIG. 1. The assembly is adjustable to vary the thrusting angle differently for thick books and thin books; effect of the bias spring 148 on its rod 150 can be regulated by a nut 152 so that the resistance of the bell crank and therefore the resisting force applied to the book by the belt 142 can be regulated, assuring the book receives a slight downward thrust in the direction of the trap door panels 42.

THE HALFWAY STATION 40

This station may also be characterized as a holding or precollector station in that a small, preliminary stack of books is built up (but no less than two books under any circumstance) and when that preliminary stack is completed the trap door 42 is sprung to the open position, so to speak, and the pre-stack drops by gravity, FIG. 1, to the collecting conveyor 45. At the collecting conveyor 45 another, bigger stack is built (no less than four) and when this final stack is completed the conveyor 45 is actuated to deliver the stack forward to the receiving station 50.

As mentioned above, the books infed by the transfer conveyor 34 are thrust and guided downward by the belt 142, FIG. 1, as they escape from the left-hand end of the bight between the in-feeding tapes 105 and 106. A pair of upright, laterally spaced guide plates 156, FIG. 4, are each supported by the legs of a pair of angles 157 and the horizontal arms of these angles are attached to the upper side of a related horizontal bar 158. The bar 158 in turn is attached to the outer side of a long frame bar 159 connected at its extreme left end by a spacer 160 to a like frame bar 159, together serving as a long cantilever support attached to the main frame plate 161, FIG. 4.

The plates 156 are adjustable to neatly capture and stabilize the partial stack of books on the plates or shelf 42 at the halfway station, in conjunction with the bumper plate 46. The plates 156 are adjustable by virtue of having slots 157S in the angles 157, receiving washer heads of screws 163 extended into the bars 158.

Also, as shown in FIG. 4, the bumper plate 46 on the far or left-hand side is provided with a pair of spaced collars 164 serving to mount the bumper plate 46 on a pair of parallel rods 166 extending through a pair of bushings 168, in turn supported in spaced relation by a laterally extending horizontal spacer bar 170.

An additional spacer bar or plate 172 is provided, also supporting a pair of bushings 174 serving as additional guide elements for the rods 166 as will be seen in FIG. 4.

The shock or momentum of an infed book striking the bumper plate 46 is absorbed by flexibly mounting the plate 46. To this end, coil springs 176 are mounted on the rods 166 and confined thereon by a pair of adjustable collars 180 secured to the rods 166. Hence when the bumper plate 46 receives a left-hand thrust from an incoming book, the rods 166 in conjunction with the coil springs 176 absorb the shock, noting that the remote left-hand ends of the rods 166 are coupled by a plate 184. A pair of rubber bushings 186 are interposed between the plate 184 and the spacer 172.

Additional momentum is absorbed by a small hydraulic cylinder 190 having a piston 192 connected to a crossbar or plate 194 secured to the rods 166 for movement therewith. Piston 192 is provided with a concentric return spring 196.

The entire structure including the plate 46, the rods 166 and the cylinder 190 constitute a large dash pot arrangement for taking the momentum out of the book being infed to the halfway station.

The machine will be preprogrammed (magnetic tape, or otherwise) so that a predetermined number of books will be collected at station 40 on the shelf or trap door 42—42 whereupon the latter will be opened to release the partial or preliminary stack for gravity drop, as mentioned above. The trap door or release platform is opened as an incident to detecting or sensing the countdown feature, means then being actuated to collapse or open the shelf 42—42. Specifically this is accomplished by the concurrent action of a pair of arms 200 effective to actuate the doors 42 to the open or releasing position.

Figure 3:
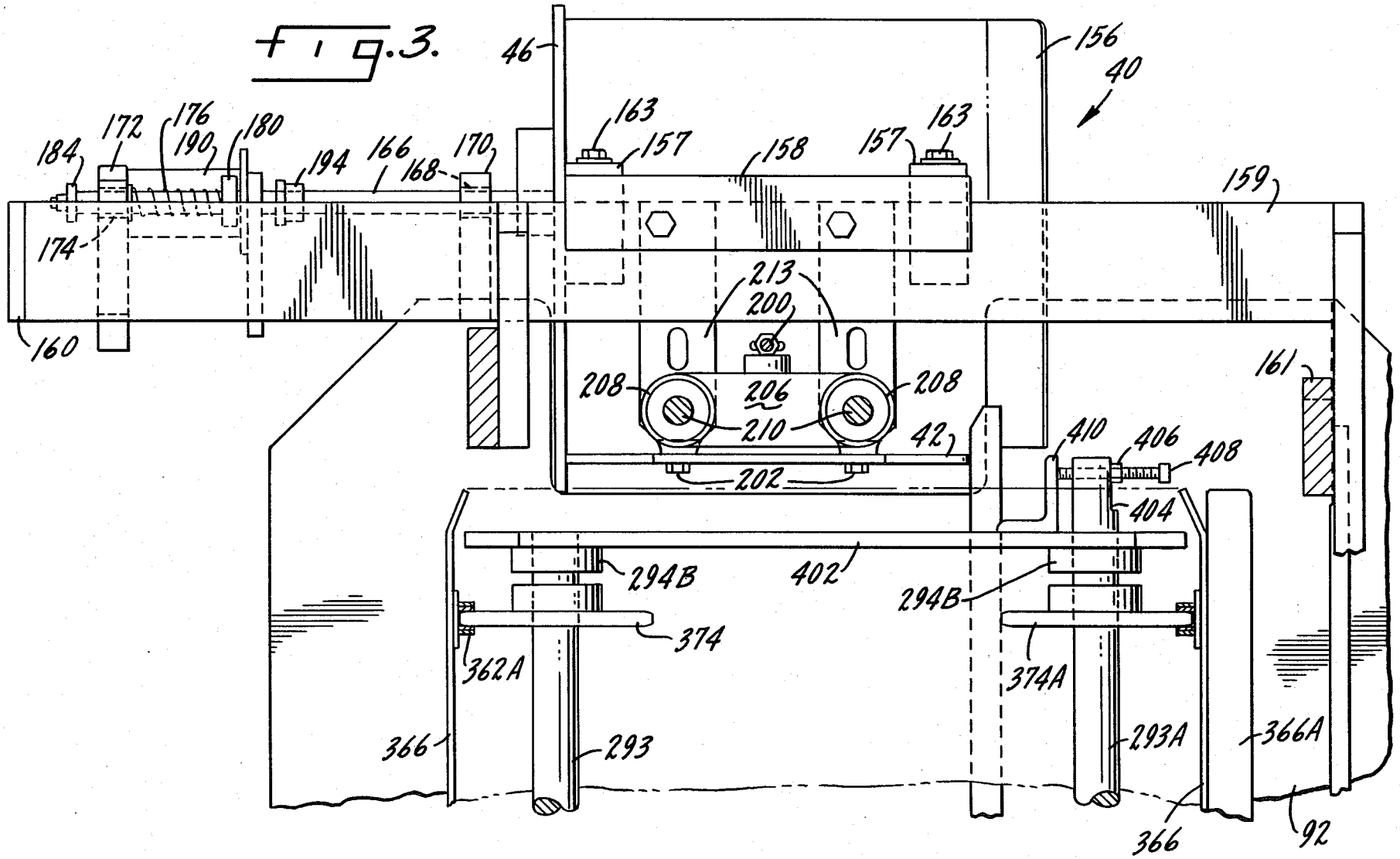
FIG. 3 is a sectional view on an enlarged scale showing details of the bumper mechanism.

To this end, the panels 42, FIG. 3, are each supported to the underside of a block 206 by screws 202. Slots (not shown) are provided in plate 42 through which the fastening screws 202 are extended, and this allows the related plate or shelf 42 to be adjusted in and out.

Block 206 carries two linear bearing cylinders 208 slidably mounted on a pair of parallel guide rods 210. The guide rods 210 are supported at one end, the outer end, in a plate 214, FIG. 2. At the opposite end, inward toward the shelf 42, the opposite ends of the rods 210 are supported in brackets 213, FIG. 3. This arrangement for the rods 210 prevails at both sides of the machine, the brackets 213 being supported in turn by the frame plate 159.

Figure 2:
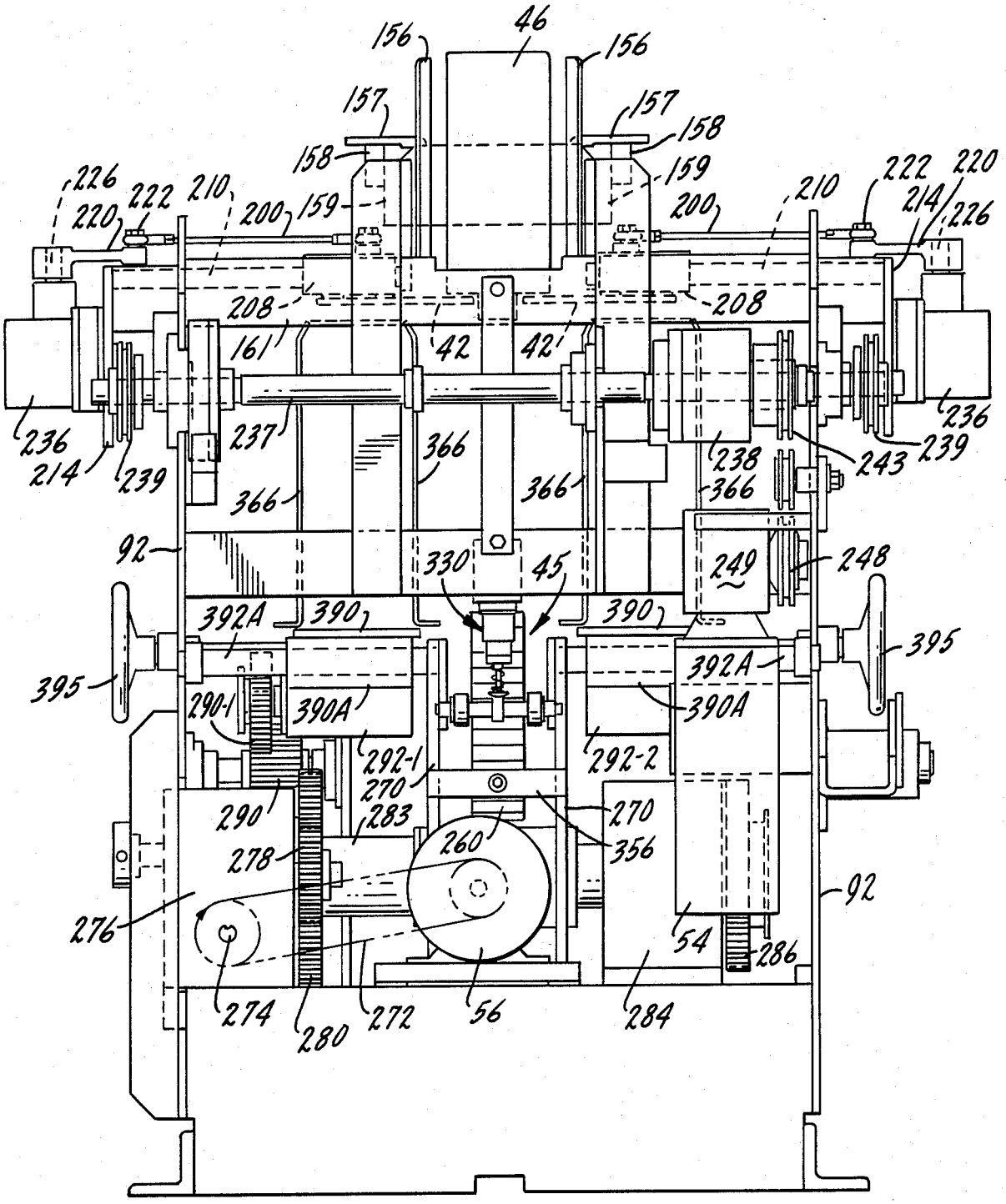
FIG. 2 is a sectional view on the line 2—2 of FIG. 1.

To operate the arms 200 to effect opening of the supports 42, respective cranks 220, FIG. 2, have their inner ends pivotally mounted on pins 222, which in turn are pivotally captured in ears at the ends of the arms 200 opposite the blocks 206, and at the blocks 206 the ends of the arms 200 are pivotally attached thereto by pins 223, FIG. 4.

The cranks 220 are secured to respective short, upright operating shafts as 226, FIG. 2. The operating shafts 226 oscillate on command as will be described and are responsible for oscillating the cranks 220, in turn responsible for reciprocating the arms 200 to displace the shelf 42—42, resulting in the partial stack of books being dropped to the collecting conveyor 45. Parallel motion of the block 206 when opening and then closing the shelf 42—42 is, of course, effected by the parallel support rods 210, FIG. 4.

The stub shafts 226 which operate the cranks in turn are driven by gearing inside gear boxes 236 and the input to the gear box, to drive the driven gearing therein, is by way of a drive chain 240 driven by sprockets 239 on a drive shaft 237, FIG. 2.

Shaft 237 is driven through a one revolution clutch 238, FIG. 2, and the input to this clutch is a sprocket 243. The shaft 237 of this sprocket is driven by a chain 246. The chain 246 is trained about a sprocket 248 driven by the DC motor 54, FIGS. 1 and 2, through a gear box 249, FIG. 2. This motor is cycled in accordance with the predetermined countdown for which the machine is programmed so that when the countdown is satisfied, motor 54 is energized resulting in release of the stack of books on the shelf 42—42.

THE COLLECTING STATION

Figures 5, 6, 7, 8:
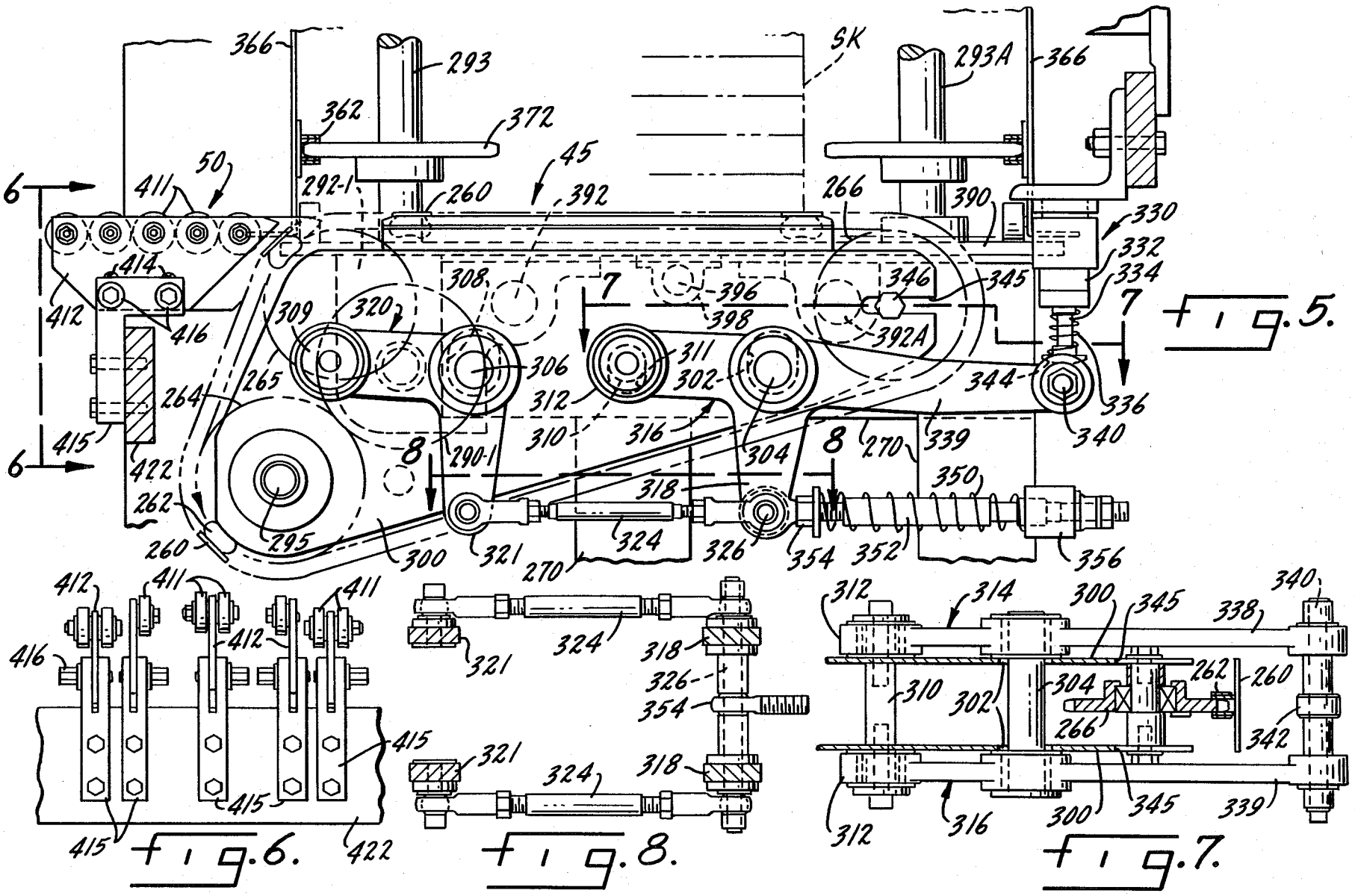
FIG. 5 is a detail view of the stacker device and the output or delivery mechanism associated therewith.
FIG. 6 is an end view on the line 6—6 of FIG. 5.
FIG. 7 is a detail plan view on the line 7—7 of FIG. 5.
FIG. 8 is a detail view on the line 8—8 of FIG. 5.

The collecting conveyor 45, FIG. 2, comprises an endless wide belt or band constructed of articulated links 260 supported by a center chain 262, FIG. 5. This chain is trained about three sprockets 264, 265 and 266. The conveyor 45 and its drive sprockets are supported on a suspension so as to absorb the weight and momentum of a partial stack of heavy books dropping from the shelf when the preliminary countdown is completed. To this end, and as shown in FIG. 2, the conveyor structure 45 is located between a pair of upright plates 270 rigidly secured to the bed of the machine as will be apparent and the manner in which the plates 270 are used to support the suspension will be described after first describing the manner in which the chain 262 for the conveyor 45 is driven.

As already mentioned, FIG. 1, the machine includes a large DC motor 56. The same motor is identified in FIG. 2 and it drives a belt 272 connected to a pulley 274 constituting the input to a gear reducer 276. The output gear 278 associated with the gear reducer is meshed with a large intermediate gear 280 and this gear constitutes the input to a clutch 283 transmitting torque to a transmission 284 (internal cam features not shown) having an output gear 286, FIGS. 1 and 2. The transmission device 284 assures the output gear 286 and the parts driven thereby are gradually brought up to speed rather than undergoing instant acceleration when clutch 283 is engaged. This assures, for example, the heavy stack of books on conveyor 45 will not be jolted.

Figure 9:
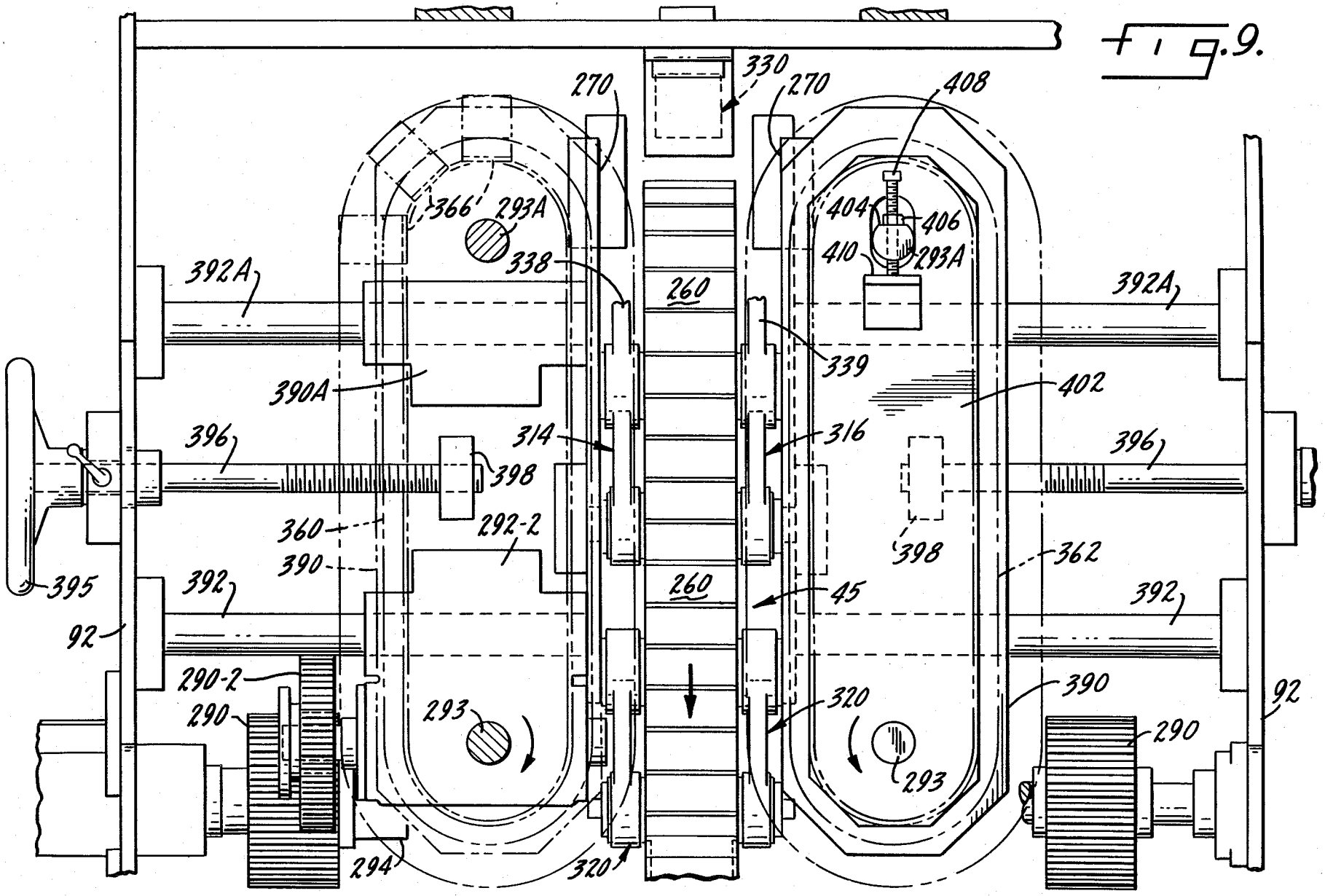
FIG. 9 is a plan view of the delivery mechanism.
Figure 10:
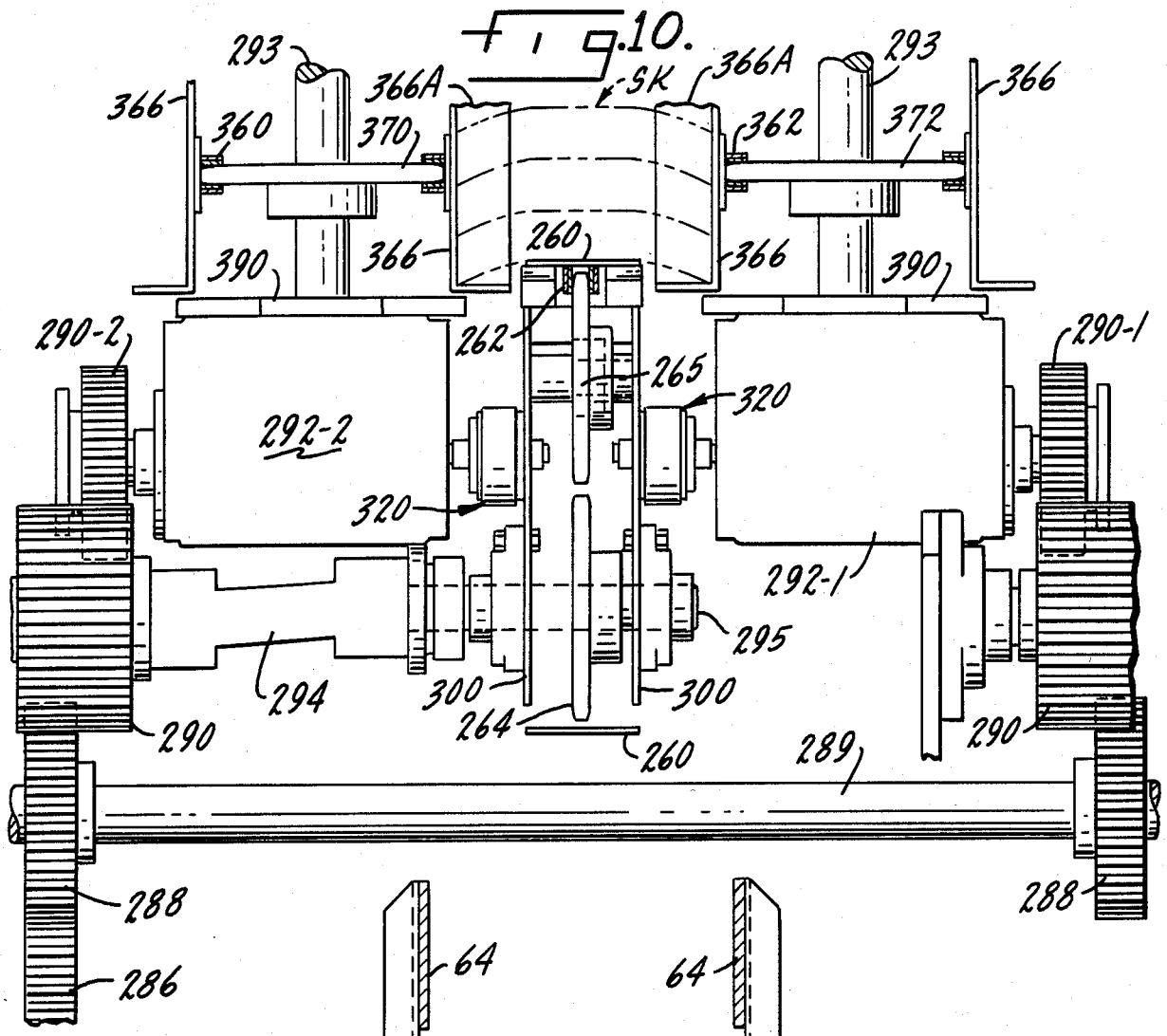
FIG. 10 is a detail view of the lower bumper or shock absorber.

The gear 286, FIG. 10, drives an intermediate gear 288 on one end of the shaft 289 which extends across the machine. The opposite end of shaft 289 carries a second such gear as 288. Each gear as 288 supported on shaft 289 is meshed with a much wider gear 290, FIG. 1, and these wide gears in turn mesh with a related pair of driving gears. One of the driving gears is shown in FIG. 10 as 290-1, and the second driving gear is shown as 290-2. These two gears 290-1 and 290-2 in turn drive right angle bevel gears (not shown) located inside a pair of gear housings 292-1 and 292-2, FIG. 10, in turn rotating respective vertical drive shafts 293, FIGS. 9 and 10. These two drive shafts are laterally spaced as will be evident in the drawing and are utilized to rotate respective sprockets engaged with a pair of opposed, endless pusher belts which deliver the completed stack of books from the collecting station as will be described in more detail below. This occurs only when clutch 283, FIG. 2, is engaged as an incident to the program for the machine by which clutch 283 is automatically cycled only when the stack is completed.

The gear system which begins with the gear reducer 276 (coupled to the DC motor 56) and which terminites in the pair of wide gears 290 respectively engaged with gears 290-1 and 290-2 is also the source for rotating the center chain 262 on the three sprockets shown in FIG. 5. In achieving this, the shaft for one of the wide gears, FIG. 10, is also employed as the input to a universal drive connection 294 coupled to a shaft 295 on which is mounted the sprocket 264 which therefore becomes the drive sprocket for chain 262.

THE SUSPENSION AT THE COLLECTING STATION

The sprockets 264, 265 and 266, FIGS. 7 and 10, are supported by and between a pair of spaced plates 300. These plates in turn are disposed between the upright, rigidly mounted plates 270, FIG. 2, and as will be described the two plates 300 are so arranged that they may flexibly undergo up and down movement as an incident to the weight of the stack of books imposed thereon. To this end a suspension is provided and the details of this arrangement will now be described.

Referring first to FIG. 7, the two plates 300 are provided with slots as 302, also denoted in FIG. 5. Each slot embraces a relatively large diameter pivot pin 304 and the ends of the pivot pin 304 are free to move within the slots 302 in the course of their up and down motion in the suspension role.

As shown in FIG. 5, there is a second, similar pivot pin 306 (supported in like fashion between the plates 270) embraced by slots 308 in the side plates 300.

The two plates 300 are joined and united for unitary movement by spacers 309 and 310, FIGS. 5 and 7. The details of the spacer 310 are shown in FIG. 7 and the description applying thereto applies equally well from the standpoint of function to the spacer 309. Thus as shown in FIG. 7, the ends of the spacer 310 outward of the side plates 300 receive collars 312 of a pair of bell cranks 314 and 316. The extreme outer ends of the spacer 310 ride in limit slots 311 provided in the side plates 270. The bell cranks 314 and 316 are pivotally mounted on the ends of the pivot pin 304 outward of the plates 300. The lower arms 318 of the bell cranks, Fi9. 5, extend beneath the pivot pin 304 for a purpose to be explained.

As shown in FIG. 5 (and in FIG. 9 as well), there will be a like pair of bell cranks 320 associated with the ends of the spacer 309, these bell cranks 320 being pivotally supported on the fixed pin 306 with their lower arms 321 extending therebeneath.

The lower ends 321 of the bell cranks 320 are coupled to the lower ends of the bell cranks 318 by extendible links as 324, and the lower bell crank arms 318 are pivotally mounted on a transverse pin 326, FIG. 8. By virtue of these pivotal connections the bell cranks pivotally mounted on the pin 306 and the bell cranks pivotally mounted on the pin 304 are constrained to rock in unison when there is a force tending to pivot the bell cranks about their pivots.

The weight of a book falling on the collecting conveyor 45 is eased and absorbed by a shock absorber system 330, FIG. 5. This shock absorber comprises a hydraulic cylinder 332 and a piston 334. The piston 334 has a return spring 336 and for transmitting the weight of the falling book to the shock absorber the two bell cranks 314 and 316, FIG. 7, have rearwardly extending arms 338 and 339 joined by a transverse pin 340. This pin at its mid-point is provided with a roller 342, FIG. 7, and this roller in turn engages a rounded head 344 at the bottom of the hydraulic piston 334, FIG. 5, whereby any counterclockwise movement of the arms 338 and 339, FIG. 5, results in an upward thrust on the hydraulic piston 336, the cylinder 332 absorbing this shock to ease the book to home position on the stationary conveyor 45. This process, of course, will be repeated for each falling partial stack of books until the complete stack is achieved.

Referring again to FIGS. 5 and 7, the aft ends of the side plates 300 are slotted at 345. The shaft on which sprocket 266 is journaled is disposed in these slots and secured therein by nuts 346 allowing this sprocket to be employed as the takeup sprocket in the chain drive system by conveyor 45.

The stacking conveyor 45 is normally maintained at a predetermined level and constantly returned to that position by a strong spring 350, FIG. 5, which surrounds a long rod 352 extending aft of rod 326, FIG. 8, to which it is pivotally coupled. Both ends of this rod are internally threaded to receive an adjustable collar 354, FIG. 5, engaged by one of the free ends of the spring 350. The opposite end of the spring 350 reacts against a block or anchor 356.

It will be recognized from what has been shown and described that the bell crank system associated with the two pivots 304 and 306 assures parallel up and down movement of the two side plates 300 and, of course, the supported plane presented by the articulated support plates 260 carried by the chain 262.

It is necessary to corral the sides of the books to assure a neat stable stack being built up and maintained on the collecting conveyor 45. This stabilizer conveyor, to be described, also assures that the stack of books will be steadied when the conveyor 45 is actuated as an incident to the stack countdown.

The stabilizer conveyor is constituted by a pair of oval races, FIG. 9, in the shape of a racetrack. Each is inclusive of a set of endless chains, there being a pair of chains on the left (360) and a pair of chains on the right (362). Since the paired chains are such that one is juxtaposed directly above the other, in the same plan, their separation cannot be discerned in FIG. 9.

Each pair of chains, the pair 360 and the pair 362, are used to secure a plurality of upright plates 366 which in the assembly have the appearance of fence posts virtually set edge to edge.

The lower set of chains 360–362 is shown in FIG. 10. Chain 360 is driven by a sprocket 370 and chain 362 is driven by a sprocket 372, each sprocket being driven by its associated drive shaft 293 actuated in the manner described above. Idler shafts 293A are paired to the drive shafts 293 as shown best in FIG. 9. Referring to FIG. 3, the extended upper portions of a pair of shafts 293 and 293A are shown. Additional sprockets 374 and 374A are secured thereto for positive engagement with the upper chain 362A.

The two drive shafts 293 and the four drive sprockets associated therewith are driven on command when a clutch-engagement signal is delivered to clutch 283. The four chains are driven in unison about the racetrack paths apparent in FIG. 9 and the completed stack is moved out of the collecting station. A portion of the stack SK is indicated by dashed line in FIG. 10 and it will be noted that the lateral edges of the books, if heavy enough, will overhang the conveyor supports 260 and are coralled by the plates 366. Selected, opposed ones of the plates 366 have inwardly extended pusher flanges 366A in vertical planes at the trailing edges of the selected plates 366 and it is these flanges which are responsible for literally pushing the stack forwardly in the direction of the station 50, FIG. 5. Not all of the plates 366 are provided with flanges 366A; only an opposed pair of plates (preferably on 18" spacing) which are employed in the pushing task.

The books may vary considerably from the standpoint of width and it therefore becomes advantageous to be able to handle most situations by supporting the stabilizer conveyor for lateral adjustment. In accomplishing this, the drive shafts 293 and the idler shafts 293A, together with their drive mechanisms and chain connections, are supported for movement toward and away from one another and to this end it may first be pointed out that the housings of 292-1 and 292-2 which are gear and bearing housings are supported at the underside of a pair of large heavy plates 390, FIGS. 9 and 10, which in turn are supported by large, sturdy mounting rods 392 on which the same are adapted to slide back and forth. The opposed ends of the support rods 392 are anchored in the upright frame structure 92 of the machine.

As shown in FIGS. 5 and 9, additional support bearings 390A and associated support rods 392A are provided for the stack stabilizer conveyor structure.

In effecting in and out movement of the conveyor operating shafts and chains an adjustment wheel as 395 is provided (one on each side of the machine) at the outer end of a long threaded shank 396 terminating at its inner end in a related nut 398. Each nut 398 is carried at the underside of the related large horizontal plate 390 (see also FIG. 5) which supports the bushings for the lower ends of shafts 293 and 293A and in this fashion the stabilizer conveyor or clamp may be closed or opened relative to the size of the books.

The upper ends of the shafts 293 and the idler shafts 293A are stabilized and journaled in bushings 294B, FIG. 3, and the bushings for the shafts thus paired are supported at the underside of top plate 402. As shown in FIG. 9, the upper end of the idler shaft 293A is provided with a flat surface 404, also shown in FIG. 3, serving as a seat for a lock nut 406 associated with an adjustment screw 408. The free end of the adjustment screw engages a lug 410 carried on the upper side of the top plate 402 and by this arrangement shaft 293A may be repositioned to take up (or slacken) the associated set of chains. This arrangement is duplicated for the opposite idler shaft 293A.

The pusher flanges 366A engage the rear edges of the stack of books and deliver the stack to rollers 411 at the receiving station 50, FIG. 5. Referring to FIG. 6, the rollers 411 are journaled on pins supported in turn by flat, upright plates 412. The plates 412 are provided with slots 414, FIG. 5, and supported in slots in holders 415 permitting up and down adjustment of the related set of rollers as a whole by virtue of loosening and tightening clamping screws 416. The clamping screws 416 are carried by the L-shaped holders 415 secured to a cross bar 422 extending between side plates of the machine. By selectively positioning the plates 412 as shown in FIG. 6 one obtains a profile which corresponds to the droop of the stack of books being delivered off the center support plates 260 of conveyor 45 which, incidentally, are actuated with the center chain concurrently with actuation of the stabilizing conveyor.

The speed of the machine will vary with the weight of the book, setting to a slower speed for thick books, higher speed for thin books. The variable speed motors are set accordingly, which means the shelves 42 will be opening and closing faster for thin books than thick, and, as noted above, the bell crank 146A–146B can also be set to the thickness of the book, steeper for thin books than thick ones.

We claim:

1. A book stacker in which books making up a partly completed preliminary stack at a halfway station are dropped from the halfway station into a second station therebeneath to come to rest atop a partly completed stack deposited the same way in the second station and comprising:

a shelf at the halfway station for collecting the books comprising the partial stack;

transfer means for feeding the books in a stream one after another to the shelf at the halfway station;

a first conveyor for delivering the books one by one to the transfer means from a lower level;

inclined frame means supporting said first conveyor in an upwardly inclined attitude to meet the transfer means;

means supporting the high end of the frame for vertical adjustment relative to said transfer means;

a normally stationary conveyor at the second station onto which the books in the preliminary stack are dropped from the shelf incidental to achieving a full vertical stack on the conveyor at the second station;

means operable in response to a countdown of books in the preliminary stack for removing the shelf from beneath the preliminary stack after the preliminary stack has been completed;

means operable in response to the achievement of a full stack for operating the conveyor at the second station to deliver to a third station the complete stack of books;

said transfer means including a high speed feed belt driven at a higher speed compared to said first conveyor, said high speed feed belt being interposed between said transfer means and the exit end of said first conveyor to accelerate a book from the conveyor to the transfer means, means resiliently supporting the conveyor at the second station to cushion the falling weight of a preliminary stack of books.

2. A book stacker according to claim 1 in which the transfer means includes a lower feed belt opposed to an upper feed belt and in which the upper feed belt is supported in a frame vertically adjustable to accommodate books of different thickness.

3. A book stacker according to claim 1 having a resiliently mounted bumper at the halfway station to remove momentum from a book delivered to the shelf.

4. A book stacker according to claim 2 having a resiliently mounted bumper at the halfway station to remove momentum from a book delivered to the shelf.

5. A book stacker according to claim 1 in which the penultimate and prepenultimate means include clutches.

6. A book stacker according to claim 1 including a stabilizing conveyor at the second station for supporting the opposed sides of the stack to stabilize the stack being delivered to the third station.

7. A book stacker according to claim 5 including a stabilizing conveyor at the second station for supporting the opposed sides of the stack to stabilize the stack being delivered to the third station.

8. A book stacker according to claim 1 in which the books are delivered one by one to the transfer means from a lower level by an input conveyor, an inclined frame supporting the input conveyor for delivering books to the transfer means along an upwardly inclined path, and means supporting the high end of last-named frame for vertical adjustment relative to entry to the transfer means.

9. A book stacker according to claim 1 having variable speed D.C. motors for operating the penultimate and prepenultimate means.

10. In a book stacker in which books making up a partly completed preliminary stack at a halfway station are dropped from the halfway station into a second station therebeneath to come to rest atop a partly completed stack deposited the same way in the second station:

a shelf at the halfway station for collecting the books comprising the partial stack;

transfer means comprising opposed feed belts for feeding the books in a horizontal path one after another to the shelf at the halfway station;

a conveyor for delivering the books one by one to the transfer means from a lower level;

inclined frame means supporting said conveyor in an upwardly inclined attitude to meet the transfer means;

means supporting the high end of said frame for vertical adjustment relative to the opposed feed belts of said transfer means; and in which the transfer means includes a high speed feed belt driven at a higher speed compared to said conveyor, said high speed feed belt being interposed between said opposed feed belts of the transfer means and the exit end of said conveyor to accelerate a book from the conveyor to the opposed feed belts.

11. A book stacker according to claim 10 in which the opposed feed belts are supported for adjustable separation to vary their separation.

12. A book stacker according to claim 10 in which said shelf is in a plane beneath said horizontal path and in which means are provided at the exit end of the transfer means to inpart a downward thrust to a book leaving the transfer means.

13. A book stacker according to claim 10 having a variable speed D.C. motor for operating the conveyor and the transfer means.

* * * * *